US005810187A

United States Patent [19]

Woodring

[11] Patent Number: 5,810,187

[45] Date of Patent: Sep. 22, 1998

[54] DRAWER ORGANIZER

[75] Inventor: Cooper C. Woodring, Topeka, Kans.

[73] Assignee: Barbara D. Arner, Oxnard, Calif.

[21] Appl. No.: 883,138

[22] Filed: Jun. 27, 1997

[51] Int. Cl.[6] ..... B65D 21/024

[52] U.S. Cl. ..... 220/23.86; 220/23.83; 220/23.4; 220/23.6; 220/410; 206/504; 206/518

[58] Field of Search ..... 220/23.6, 23.4, 220/23.83, 23.86, 23.2, 528, 527, 410, 408, 4.21, 4.24, 507, 735, 737; 206/504, 514, 518

[56] References Cited

U.S. PATENT DOCUMENTS

| | | | |
|---|---|---|---|
| 2,815,855 | 12/1957 | Fisher . | |
| 3,343,706 | 9/1967 | Berend . | |
| 3,425,586 | 2/1969 | Petters et al. | 220/23.4 |
| 4,170,082 | 10/1979 | Freedman | 220/23.4 |
| 4,728,234 | 3/1988 | Reynard | 220/23.4 |
| 4,919,268 | 4/1990 | Young et al. | 220/23.4 |
| 4,969,568 | 11/1990 | Yoshida . | |
| 5,050,755 | 9/1991 | Strawder . | |
| 5,054,636 | 10/1991 | Netzer | 220/23.4 |
| 5,139,299 | 8/1992 | Smith | 220/23.4 |
| 5,181,297 | 1/1993 | Andrews et al. . | |

FOREIGN PATENT DOCUMENTS

| | | | |
|---|---|---|---|
| 1 259 532 | 1/1968 | Germany | 220/23.4 |

*Primary Examiner*—Stephen J. Castellano

*Attorney, Agent, or Firm*—Oppenheimer Wolff & Donnelly LLP

[57] ABSTRACT

A drawer organizer assembly including a plurality of releasably interlocked juxtaposed containers, each container having a bottom wall and a plurality of interconnected side walls open at the top. A peripheral ledge surrounds each open top having a plurality of spaced corners, each ledge having an cut-out section at each of the corners with one ledge of one container abutting against the ledge of an adjacent container. A plurality of connectors are disposed in certain ones of the cut-out sections, the connectors mounted in the cut-out sections of one container which abuts against adjacent cut-out sections of another container being connected to both of the containers at the abutting cut-out sections.

13 Claims, 5 Drawing Sheets

FIG. 2
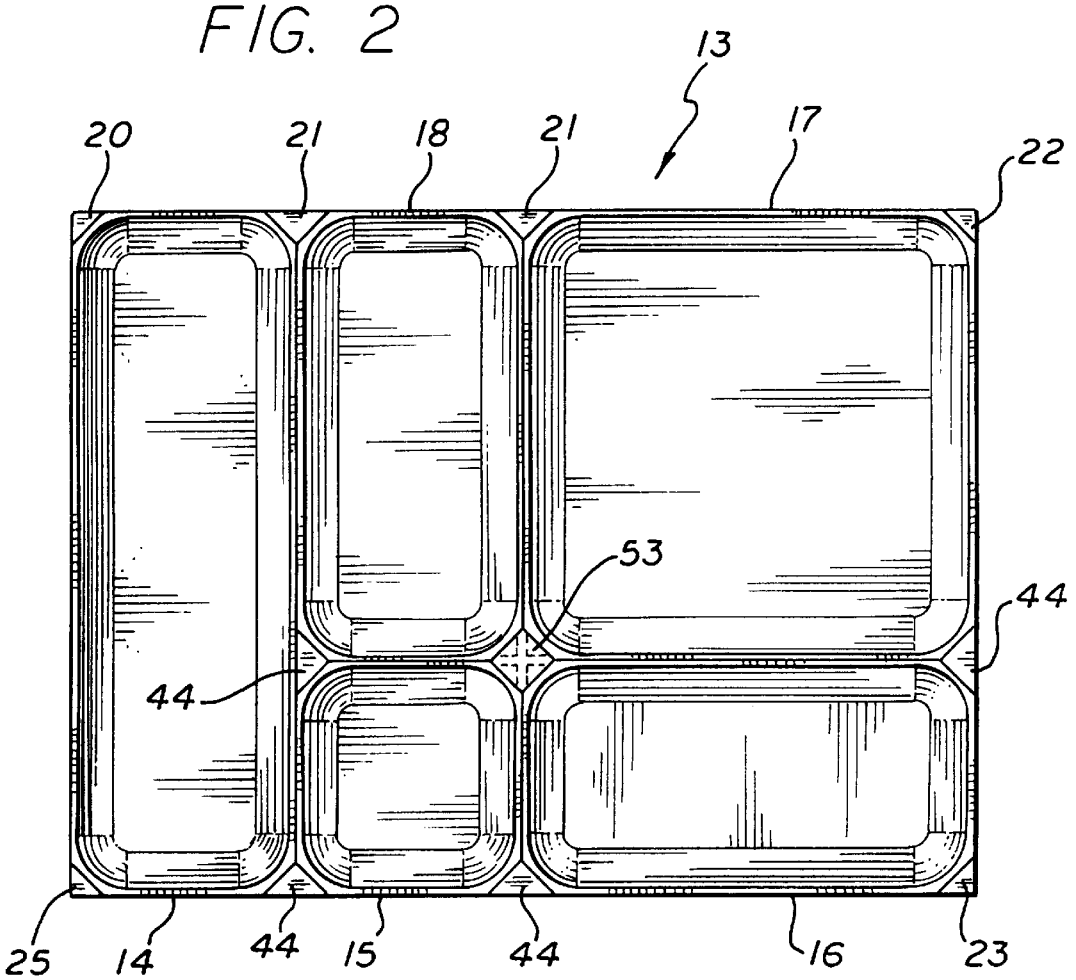
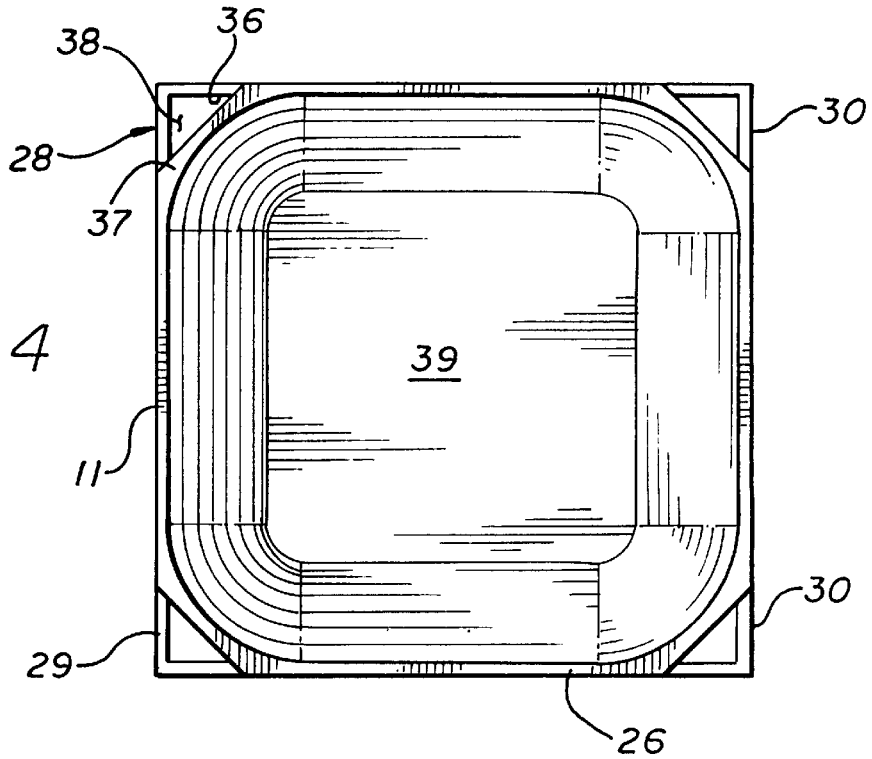
FIG. 4

DRAWER ORGANIZER

BACKGROUND OF THE INVENTION

The invention relates to drawer organizers; and, more particularly, to separable interlocked units that can be placed in a dresser drawer or the like to sort objects.

BACKGROUND INFORMATION

Drawer organizers are known for forming divisions within a conventional drawer to suit the needs of the user. Some may require larger sections than others for a particular item, such as socks. One such organizer is disclosed in U.S. Pat. No. 3,343,706 to Berend. Berend however requires intricate notched flanges to be used to interconnect a plurality of units together. There is thus a need for a quick interlocking drawer organizer which may have units of varying capacities and one which can be inexpensively manufactured and assembled.

SUMMARY OF THE INVENTION

It is an object of this invention to provide an interlocking drawer organizer.

It is a further object of this invention to provide a drawer organizer which may be comprised of units of differing capacities that can be quickly and easily locked together.

These and other objects are preferably accomplished by providing a drawer organizer assembly including a plurality of releasably interlocked juxtaposed containers, each container having a bottom wall and a plurality of interconnected side walls open at the top. A peripheral ledge surrounds each open top having a plurality of spaced corners, each ledge having an cut-out section at each of the corners with one ledge of one container abutting against the ledge of an adjacent container. A plurality of connectors are disposed in respective ones of the cut-out sections, the connectors mounted in the cut-out sections of one container which abut against adjacent cut-out sections of another container being connected to both of the containers at the abutting cut-out sections.

BRIEF DESCRIPTION OF THE DRAWING

FIG. 2 is a top plan view of a modification of a drawer organizer assembly in accordance with the teachings of my invention;

FIG. 4 is a top plan view of one of the containers of FIG. 1;

DESCRIPTION OF THE PREFERRED EMBODIMENT

Figure 1:
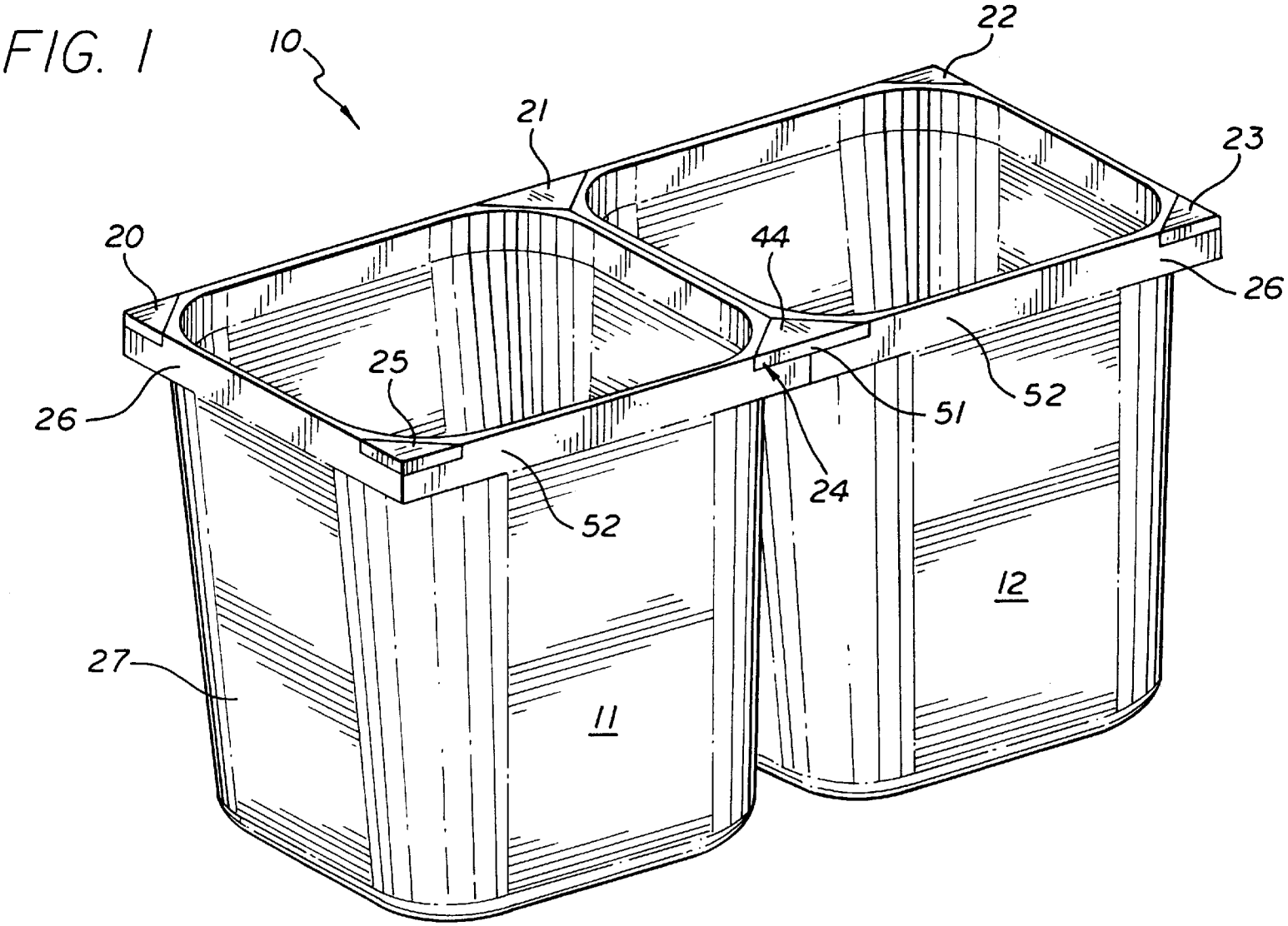
FIG. 1 is a perspective view of a drawer organizer assembly in accordance with the teachings of my invention.

Referring now to FIG. 1 of the drawing, a drawer organizer assembly 10 is shown comprised of a plurality, such as two, of side by side containers 11, 12. Containers 11, 12 are shown in FIG. 1 as identical and thus of substantially the same dimensions and capacity. However, the containers need not be identical and one may be of larger capacity than the other. For example, as seen in FIG. 2, the drawer organizer assembly 13 comprises a plurality of interlocked containers 14 through 18 which vary in length and width. In any event, each assembly 10 ,13 is adapted to be disposed in a drawer or the like, such as in a dresser, and the overall length, width and height is related to the internal length, width, and height of the drawer in which the assembly is mounted.

Figure 3:
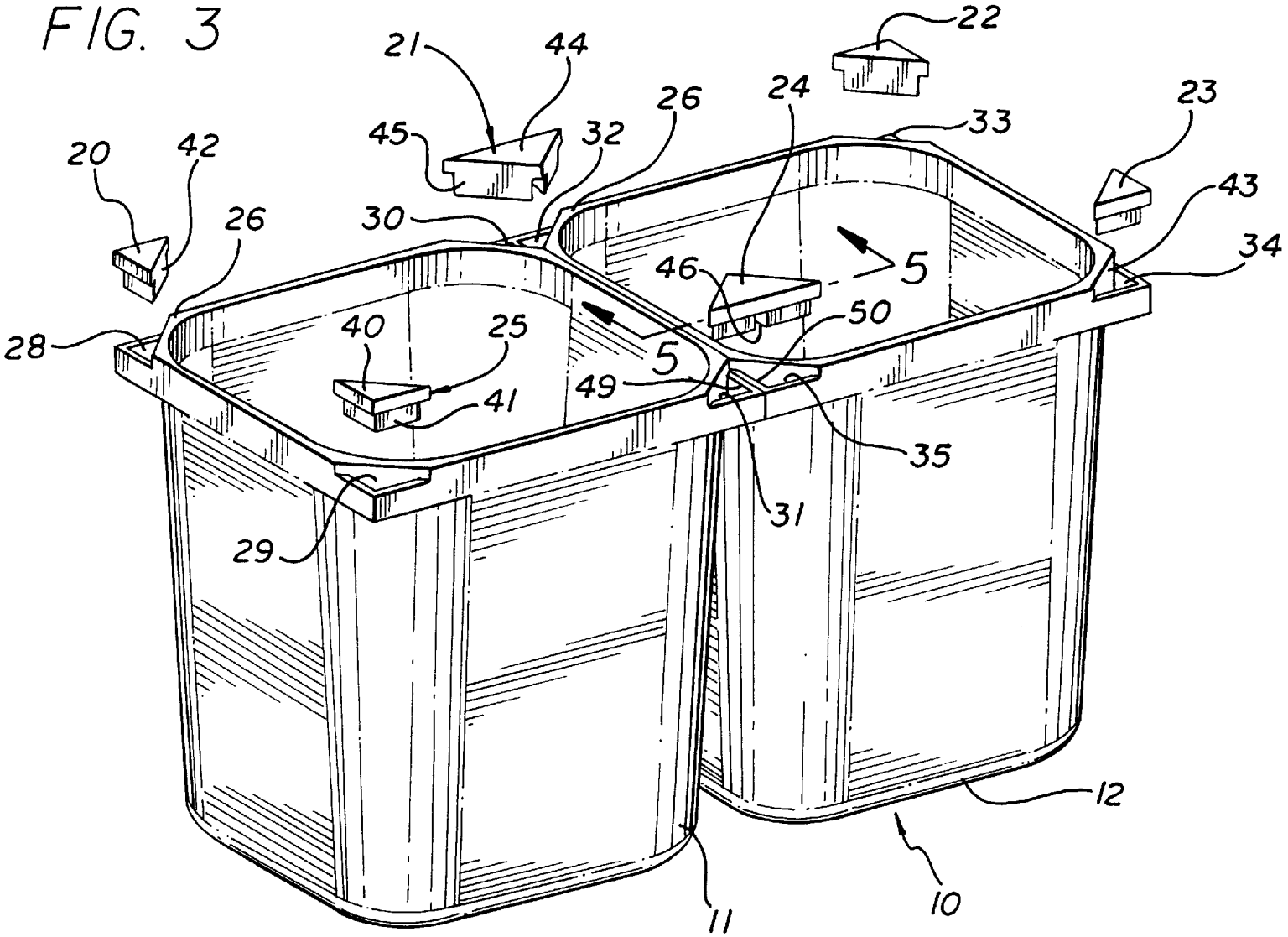
FIG. 3 is an exploded perspective view of the drawer organizer assembly of FIG. 1.

Referring again the assembly 10 of FIG. 1, container 11 is interlocked to container 12 by a plurality of connectors 20 through 25. As is more particularly shown in FIG. 3, each container 11, 12 has an upper peripheral ledge 26 extending about the open tops of each container. Containers 11, 12 each have a bottom wall 39 (see FIG. 4) and upstanding interconnected side walls 27 (FIG. 1) forming a bin for depositing clothing or the like therein. Each ledge 26 (FIG. 3) has a cut-out corner section such as sections 28 through 31 in container 11 and sections 32 through 35 in container 12. As seen in FIG. 3, when container 11 is disposed in abutting relation to container 12, the cut-out sections 30, 32 and 31, 35 meet. Also, each cut-out section has a peripheral wall 36 (see FIG. 4) extending from the main body portion 37 of ledge 26 surrounding a triangularly shaped receptacle 38. As seen in FIG. 3, connectors 20 through 25 are adapted to be mounted in the cut-out sections 28, 30, 32, 33, 34, 35, 31, and 29.

Connectors 20, 22, 23, and 25 are identical, each having a triangularly shaped top wall 40 integral with a downwardly extending plug portion 41. As seen in FIG. 3, wall 40 extends beyond plug portion 41 on two sides thereof. On the third side, wall 40 is flush with plug portion 41 (see wall 42 at connector 20 in FIG. 3).

Thus, connectors 20, 22, 23, and 25 are adapted to be mounted in cut-out sections 28, 29, 33, and 34, the plug portions 41 extending down into receptacle 38 (FIG. 4) with walls 42 abutting against wall 43 (see the undercut section 34 in FIG. 3). The upper surfaces of top walls 20 are flush with the upper surface of ledges 26 as seen in FIG. 1.

Figure 5:
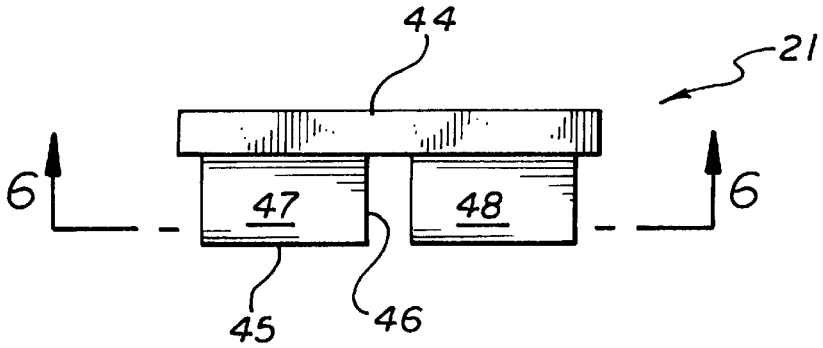
FIG. 5 is a view taken along lines 5—5 of FIG. 3.
Figure 6:
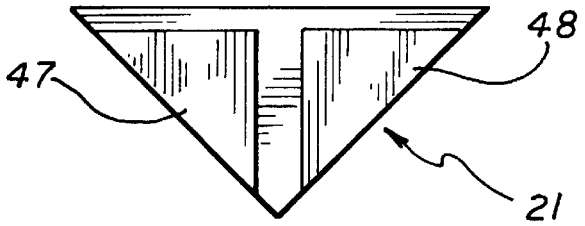
FIG. 6 is a view taken along lines 6—6 of FIG. 5.

Connectors 21 and 24 serve to releasably interlock one container, such as container 11, to the other, such as container 12. Thus, connectors 21 and 24 (see also connector 21 in FIGS. 5 and 6), being identical, each have a top wall 44 (see connector 21 in FIG. 3) integral with a plug portion 45. As seen in FIG. 5, plug portion 45 has a notch 46 separating two side portions 47, 48 of plug portion 45 (see also FIG. 6). As seen in FIG. 3, notches 46 fit over the abutting flanges 49, 50 of abutting ledges 26 thus interlocking one container to the other. As seen in FIG. 1, the outer side peripheral wall portion 51 of top wall 44 is flush with the outer side peripheral walls 52 of ledges 26.

Figure 7:
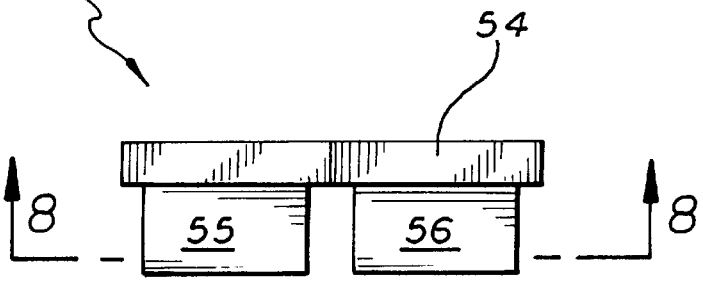
FIG. 7 is an elevational view of one of the connectors of the assembly of FIG. 2 removed therefrom.
Figure 8:
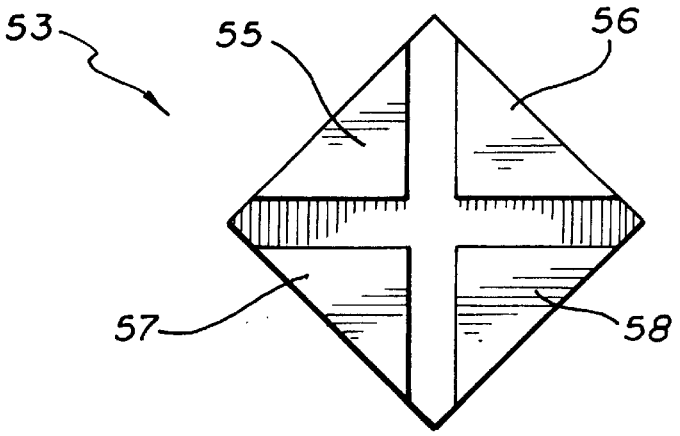
FIG. 8 is a view taken along lines 8—8 of FIG. 7.

As seen in FIG. 2, containers 15 to 18 are also interconnected by connectors, like numerals referring to like connectors of FIGS. 1 and 3 to 5. However, connector 53 locks four containers together and, as seen in FIGS. 2 and 7, has a diamond shaped top wall 54 and four triangularly shaped downwardly extending integral plug portions 55 through 58 (FIG. 8) forming an X-shaped groove. This groove receives therein the mating walls of containers 15 to 18 as shown in dotted lines in FIG. 2 thus locking containers 15 to 18 together.

Figure 9:
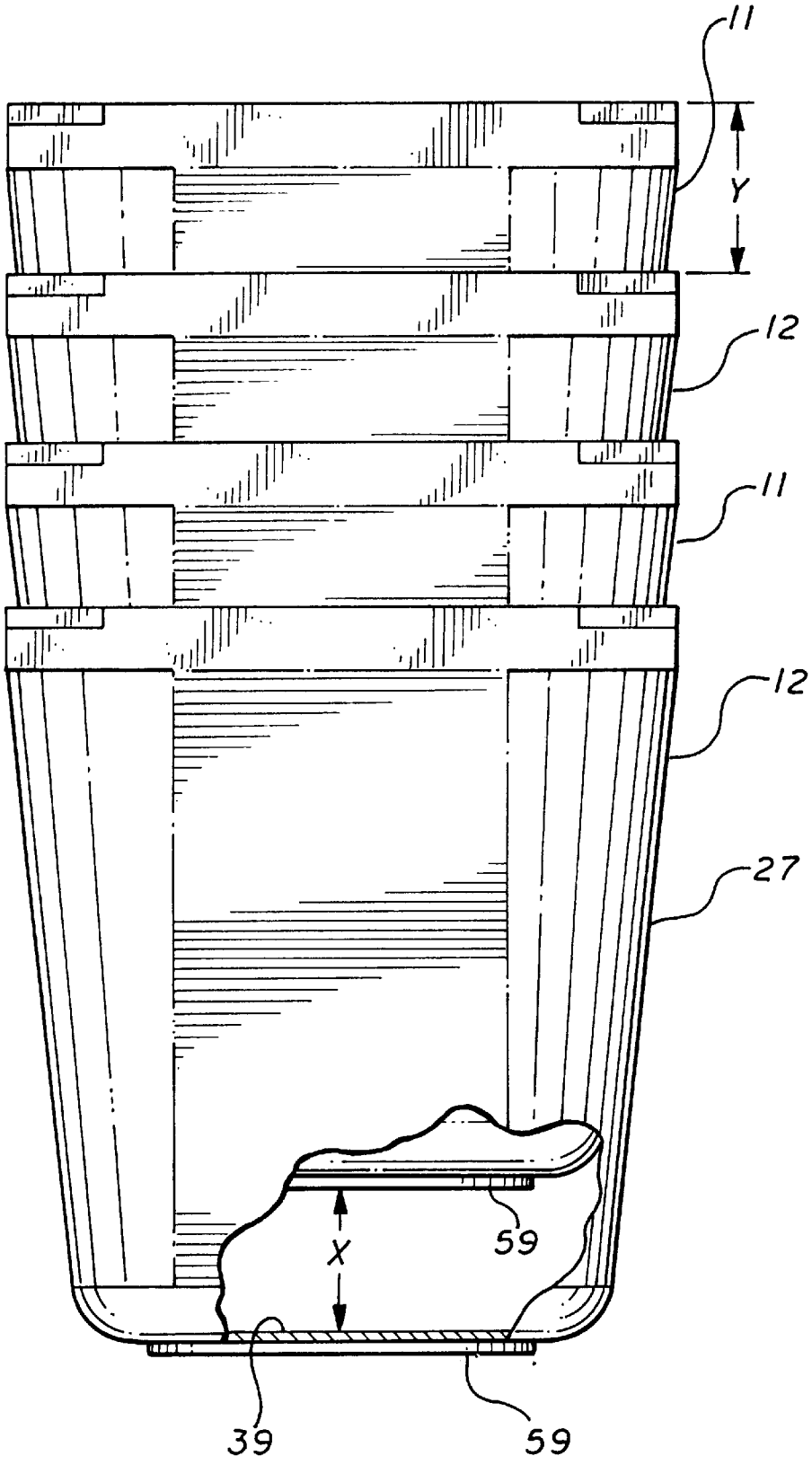
FIG. 9 is an elevational view illustrating the stacking of a plurality of containers.

As seen in FIG. 9, one container (the like configured containers, such as containers 11, 12 of FIG. 1) may be stacked inside the other due to the tapered side walls 27.

Thus, one container 11 is stacked inside of container 12, container 12 being stacked inside of another container 11, etc. The distance y between the upper edge of each stacked container and the upper edge of the next stacked container is about 1". Thus, the containers can be stored or shipped accordingly. Similar sized containers, e.g., containers 16, 18 in FIG. 2, may be stacked in like manner (the side walls also being tapered as side walls 27 in FIG. 1).

Any suitable materials, such as various plastics, opaque or transparent, may be used. Any suitable dimensions may be used. For example, containers 11, 12 may be about 4" square at top, tapering to a bottom wall about 3.250 inches square and of an overall length of about 4.5". As seen in FIG. 9, each container 11, 12 has a peripheral flange 59 forming a foot with a storage area, indicated by arrow x, being formed between flange 59 of container 11 and the bottom wall 39 of container 12 for storing the connectors.

The dimensions of the containers of FIG. 2 are similar, each being about 4.5" in overall height. Containers 16, 18 may be about 4"×8"; container 15 may be about 4"×4"; container 14 may be about 4"×12" and container 17 may be about 8"×8". The various connectors are press fit into place to releasably interlock the containers.

The cut-out corner sections or triangular extensions of ledge 26 may have a closed bottom surface to add structural integrity, in which case either the closed bottom surface or the insertable connector may have a hole therethrough to allow air to escape when the connector is inserted. The connector is preferably of a resilient material for a tight compressionable fit. In the preferred embodiment, the cut-out corner sections or triangular extensions may have an open bottom, allowing air to escape.

Objects that fit together, such as the containers herein, in a plurality of orientations and combinations are generally referred to a "modular" where each greater dimension is a multiple of some lesser dimension, for example 4", 8", 12", etc. This assures the corners will align with one another or with a modular increment of a greater dimensioned part.

The connectors are envisioned to be injection molded of a resilient plastics material, such that they will assure a tight and compressionable fit to secure the modular containers together in a rattle-free manner that will also accommodate a slightly uneven dresser drawer bottom surface.

One additional purpose of the invention is to allow any individual container to be easily removed from within an assembled maze of containers. The Berend Patent No. 3,343,706 has one side that hooks over one side of another container. This does not allow each container to be removed as most are "trapped" by another neighboring container. Additionally, since only one side is attached to a neighboring container, some contiguous sides remain unattached, causing gaps between containers and creating the potential for rattling. It should be noted thus that some connectors do not, in fact, "connect," but are simply "finishing" devices to fill in any empty corner when no connection is being made to another container. An example of these is shown in FIG. 1, connectors 20, 22, 23, and 25. Also in FIG. 1, connectors 21 and 24 do actually connect together containers 11 and 12.

Obviously, other sizes and configurations may be used. However, the containers disclosed herein can be readily interlocked and mounted in a drawer providing bins or containers for the storage of different types of clothing items therein. Obviously, such containers can be used to separate and store other items, such as silverware, hobby items, etc.

Although a specific embodiment of the invention is disclosed, variations thereof may occur to an artisan and the scope of the invention is only to be limited by the scope of the appended claims.

I claim:

1. A drawer organizer assembly comprising:

a plurality of releasably interlocked juxtaposed containers conforming, when interlocked, to the interior of a conventional drawer in a chest of drawers, said containers forming a single layer of interconnected containers, each container having a bottom wall and a plurality of interconnected side walls open at the top, a peripheral ledge surrounding each open top having a plurality of spaced corners, each ledge having a cut-out section providing a receptacle enclosed on all sides at each of said corners with one ledge of one container abutting against the ledge of an adjacent container; and a plurality of connectors, said connectors being disposed in certain ones of the receptacles of said cut-out sections, said connectors mounted in said cut-out sections of one container which abuts against adjacent cut-out sections of another container being connected to both of said containers at said abutting cut-out sections.

2. The assembly of claim 1 wherein each of said cut-out sections include a receptacle therein, each of said connectors having a top wall and an integral plug portion receivable in said receptacles.

3. The assembly of claim 1 wherein each of said cut-out sections include said wall surrounding a receptacle, each of said connectors having an top wall and an integral plug portion receivable in said receptacle.

4. The assembly of claim 3 wherein said walls of one of said cut-out sections abutting against the walls of another of said cut-out sections are interconnected by said plug portion having a first portion separated by a second portion, said first portion extending down into the receptacle of one of said cut-out sections and the second portion extending down into the receptacle of the other of said cut-out sections, said abutting walls being disposed between said first and second portions.

5. The assembly of claim 1 wherein said connectors are flush with the upper surface of said ledges.

6. The assembly of claim 1 wherein said containers have four interconnected side walls, said side walls tapering from the top of said containers inwardly toward the bottom walls thereof whereby one container may be stacked inside of another container.

7. The assembly of claim 1 wherein both of said containers are generally rectangular in cross section.

8. The assembly of claim 1 wherein one of said containers is generally square in cross-section and another of said containers is generally an elongated rectangle in cross-section.

9. The assembly of claim 1 wherein at least four of said containers are interconnected to each other, said containers being interconnected by a single connector mounted in said juxtaposed cut-out sections.

10. The assembly of claim 9 wherein each of said juxtaposed cut-out sections has a receptacle therein.

11. The assembly of claim 10 wherein said single connector has four plug portions, each of said plug portions being disposed in the respective receptacle of each of said cut-out sections.

12. A drawer organizer assembly comprising:

a plurality of releasably interlocked juxtaposed containers, each container having a bottom wall and a plurality of interconnected side walls open at the top, a peripheral ledge surrounding each open top having a plurality of spaced corners, each ledge having a cut-out section at each of said corners with one ledge of one container abutting against the ledge of an adjacent container; and a plurality of connectors, said connectors being disposed in certain ones of said cut-out sections, said connectors mounted in said cut-out sections of one container which abuts against adjacent cut-out sections of another container being connected to both of said containers at said abutting cut-out sections, each of said cut-out sections including a wall surrounding a receptacle, each of said connectors having a top wall and an integral plug portion receivable in said receptacle, said walls of one of said cut-out sections abutting against the walls of another of said cut-out sections being interconnected by said plug portion having a first portion separated by a second portion, said first portion extending down into the receptacle of one of said cut-out sections and the second portion extending down into the receptacle of the other of said cut-out sections, said abutting walls being disposed between said first and second portions.

13. A drawer organizer assembly comprising:

a plurality of releasably interlocked juxtaposed containers, each container having a bottom wall and a plurality of interconnected side walls open at the top, a peripheral ledge surrounding each open top having a plurality of spaced corners, each ledge having a cut-out section at each of said corners with one ledge of one container abutting against the ledge of an adjacent container; and a plurality of connectors, said connectors being disposed in certain ones of said cut-out sections, said connectors mounted in said cut-out sections of one container which abuts against adjacent cut-out sections of another container being connected to both of said containers at said abutting cut-out sections, said containers having four interconnected side walls, said side walls tapering from the top of said container inwardly toward the bottom walls thereof whereby one container may be stacked inside of another container.

* * * * *